US010041696B2

(12) United States Patent
Ogura

(10) Patent No.: US 10,041,696 B2
(45) Date of Patent: Aug. 7, 2018

(54) CEILING-EMBEDDED AIR CONDITIONER

(71) Applicant: FUJITSU GENERAL LIMITED, Kawasaki-shi, Kanagawa-ken (JP)

(72) Inventor: Taku Ogura, Kawasaki (JP)

(73) Assignee: FUJITSU GENERAL LIMITED, Kawasaki-Shi, Kanagawa-Ken (JP)

( * ) Notice: Subject to any disclaimer, the term of this patent is extended or adjusted under 35 U.S.C. 154(b) by 288 days.

(21) Appl. No.: 15/080,861

(22) Filed: Mar. 25, 2016

(65) Prior Publication Data

US 2016/0290676 A1 Oct. 6, 2016

(30) Foreign Application Priority Data

Mar. 31, 2015 (JP) ..... 2015-070926

(51) Int. Cl.

| | |
|---|---|
| ***F24D 5/10*** | (2006.01) |
| ***F24D 19/02*** | (2006.01) |
| ***F24H 9/06*** | (2006.01) |
| ***F24F 13/20*** | (2006.01) |
| ***F24F 1/32*** | (2011.01) |
| ***F24F 13/22*** | (2006.01) |
| ***F24F 13/30*** | (2006.01) |
| *F24F 11/88* | (2018.01) |
| *F24F 11/89* | (2018.01) |
| *F24F 1/00* | (2011.01) |

(52) U.S. Cl.

CPC ..... *F24F 13/20* (2013.01); *F24F 1/0014* (2013.01); *F24F 1/0022* (2013.01); *F24F 1/32* (2013.01); *F24F 13/22* (2013.01); *F24F 13/30* (2013.01); *F24F 11/88* (2018.01); *F24F 11/89* (2018.01); *F24F 2001/0037* (2013.01); *F24F 2221/14* (2013.01)

(58) Field of Classification Search

CPC ..... F24F 1/0014; F24F 1/0022; F24F 11/88; F24F 11/89; F24F 2221/14

USPC ..... 165/53

See application file for complete search history.

(56) References Cited

U.S. PATENT DOCUMENTS

2009/0025414 A1* 1/2009 Koga ..... F24F 1/0007 62/263
2011/0240255 A1* 10/2011 Sakashita ..... F24F 1/0007 165/53

FOREIGN PATENT DOCUMENTS

JP 09303815 A * 11/1997
JP 2000257905 A * 9/2000
JP 2004092997 A * 3/2004
JP 2006153452 A * 6/2006

(Continued)

*Primary Examiner* — Len Tran
*Assistant Examiner* — Paul Alvare
(74) *Attorney, Agent, or Firm* — Manabu Kanesaka

(57) ABSTRACT

A ceiling-embedded air conditioner includes: a pipe draw portion that is provided at one corner portion of a casing main body to draw refrigerant pipes together with an electric wire; a pipe cover that fixes the peripheries of the refrigerant pipes and has a draw hole for the electric wire; a wire cover that is provided on the bottom surface of the casing main body and cover a wire guide groove for the electric wire; a cover plate that is included in the wire cover, covers the wire guide groove, and is screwed to a predetermined place on the casing main body side; and a hold plate that is included in the wire cover and is folded at a right angle from one end of the cover plate to engage with a pipe cover end portion of the pipe cover on the bottom surface side of the casing main body.

4 Claims, 10 Drawing Sheets

(56) References Cited

FOREIGN PATENT DOCUMENTS

| | | | | | |
|---|---|---|---|---|---|
| JP | 3813407 | B2 | * | 8/2006 | |
| JP | 3895999 | B2 | * | 3/2007 | |
| JP | 2010159910 | A | * | 7/2010 | |
| JP | 2010159911 | A | * | 7/2010 | |
| JP | 4582817 | B2 | * | 11/2010 | ..... F24F 1/0007 |
| JP | 2011-169583 | A | | 9/2011 | |
| JP | 2011-202925 | A | | 10/2011 | |

* cited by examiner

CEILING-EMBEDDED AIR CONDITIONER

CROSS-REFERENCE TO RELATED APPLICATION

This application claims priority from Japanese Patent Application No. 2015-070926 filed with the Japan Patent Office on Mar. 31, 2015, the entire content of which is hereby incorporated by reference.

BACKGROUND

1. Technical Field

The present disclosure relates to a ceiling-embedded air conditioner, more specifically to a structure of a pipe draw portion.

2. Description of the Related Art

The ceiling-embedded air conditioner has a casing main body. The casing main body includes a heat exchanger and an air blower (turbo fan) inside, and is embedded in a space formed between a ceiling slab and a ceiling panel. A square decorative panel is mounted on the bottom surface (facing the interior of a room) of the casing main body. In general, an air suction opening is provided in the center of the decorative panel, and air blowoff openings are provided around the air suction opening.

A pipe draw portion is provided on the side wall of the casing main body to draw a refrigerant pipe to the outside. For example, as illustrated in JP-A-2011-202925, the pipe draw portion is generally a cutout portion formed by cutting out partially the side walls of the casing main body at and around a corner portion. A pipe cover is attached to the pipe draw portion to fix a refrigerant pipe. The pipe cover has a wire draw hole. The wire draw hole is used to draw to the outside an electric wire from an electric equipment box housed in the casing main body. The refrigerant pipe and the electric wire are drawn from almost the same position. The electric wire is guided from the electric equipment box through a wire guide groove as a concave groove formed in the bottom surface of a drain pan to the wire draw hole. In general, a wire cover is screwed to the opening surface of the wire guide groove. When the wire cover is removed, the electric wire appears on the bottom surface of the casing main body.

In addition, as described in FIG. 4 of JP-A-2011-169583, for example, a foamed resin heat insulator is disposed on the inner peripheral surface of the casing main body. A seal portion is provided on the heat insulator near the pipe draw portion and is in abutment with the end plate of the side end portion of the heat exchanger.

SUMMARY

A ceiling-embedded air conditioner includes: a ceiling-embedded casing main body that includes a heat exchanger, a turbo fan, and an electric equipment box inside, and has an air blowoff opening and an air suction opening in a bottom surface; a pipe draw portion that is provided at one corner portion of the casing main body and is formed by cutting out part of the casing main body to draw refrigerant pipes of the heat exchanger together with an electric wire of the electric equipment box; a pipe cover that is included in the pipe draw portion, fixes the peripheries of the refrigerant pipes, and has a draw hole for the electric wire; a wire cover that is provided on the bottom surface of the casing main body and covers a wire guide groove for the electric wire, the wire guide groove being formed from the electric equipment box to the pipe draw portion; a cover plate that is included in the wire cover, covers the wire guide groove, and is screwed to a predetermined place on the casing main body side; and a hold plate that is included in the wire cover and is folded at a right angle from one end of the cover plate to engage with a pipe cover end portion of the pipe cover on the bottom surface side of the casing main body.

DESCRIPTION OF THE EMBODIMENTS

Figure 1:
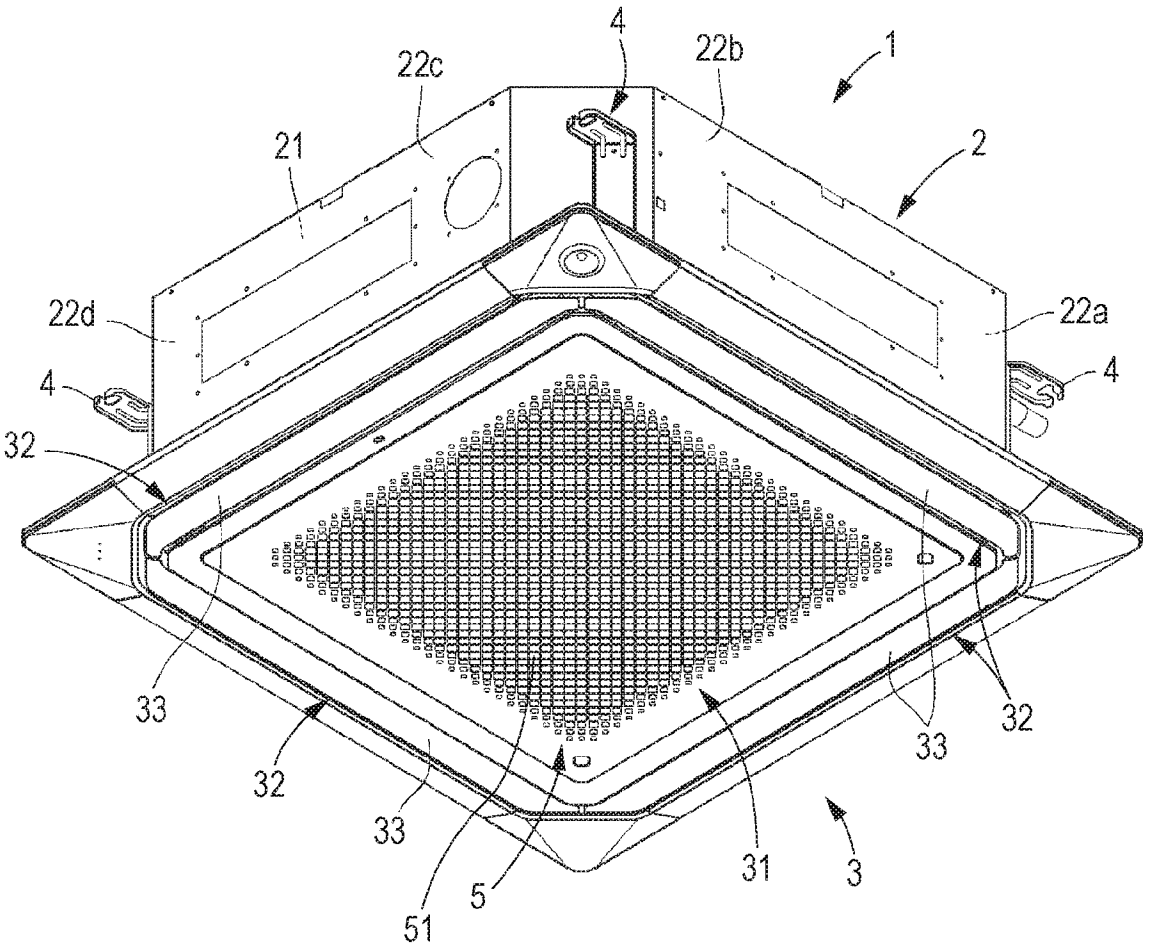
FIG. 1 is a perspective external view of a ceiling-embedded air conditioner according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

A casing main body is box-shaped with the bottom surface opened. Accordingly, the end portion of the casing main body on the bottom surface side as the opening end side has low mechanical strength. Therefore, the end portions of the side plates of the casing main body are likely to open outward. In particular, the pipe draw portion is provided at a stepped portion formed by recessing inward the side walls of the casing main body to avoid a pipe joint protruding from the side surfaces of the casing main body. Further, the pipe draw portion is cut out and lower in mechanical strength than the other portions. The pipe draw portion is thus likely to protrude outward.

When the end portions of the side plates of the casing main body open outward, a gap is produced between a seal portion of a heat insulator and the end plates of the side end portions of the heat exchanger. The non-heat exchanged air leaks from the gap.

An object of the present disclosure is to provide a ceiling-embedded air conditioner as described below. The ceiling-embedded air conditioner is enhanced in mechanical strength at and around the pipe draw portion of the casing main body.

A ceiling-embedded air conditioner according to an aspect of the present disclosure (the present air conditioner) includes: a ceiling-embedded casing main body that includes a heat exchanger, a turbo fan, and an electric equipment box inside, and has an air blowoff opening and an air suction opening in a bottom surface; a pipe draw portion that is provided at one corner portion of the casing main body and is formed by cutting out part of the casing main body to draw refrigerant pipes of the heat exchanger together with an electric wire of the electric equipment box; a pipe cover that is included in the pipe draw portion, fixes the peripheries of the refrigerant pipes, and has a draw hole for the electric wire; a wire cover that is provided on the bottom surface of the casing main body and covers a wire guide groove for the electric wire, the wire guide groove being formed from the electric equipment box to the pipe draw portion; a cover plate that is included in the wire cover, covers the wire guide groove, and is screwed to a predetermined place on the casing main body side; and a hold plate that is included in the wire cover and is folded at a right angle from one end of the cover plate to engage with a pipe cover end portion of the pipe cover on the bottom surface side of the casing main body.

In a more preferable aspect, the cover plate has L-shaped guide grooves at two places, the guide grooves have: first guide paths that extend in a first direction orthogonal to one side of the cover plate with the hold plate; and second guide paths that extend in a second direction orthogonal to the first direction from ends of the first guide paths on the hold plate side, the casing main body has a male screw and an engagement convex portion in predetermined positions, the male screw is configured to support the movement of the cover plate along the one guide groove and fix the cover plate in a predetermined position, and the engagement convex portion supports the movement of the cover plate along the other guide groove.

In another aspect, a foamed resin heat insulator is disposed on the inner peripheral surface of the casing main body, at a predetermined place of the heat insulator, a seal portion in abutment with an end plate of a side end portion of the heat exchanger extends in a direction parallel to an engagement surface between the hold plate and the pipe cover end portion, and when the wire cover engages with the pipe cover end portion, the seal portion is pressed against the end plate of the side end portion of the heat exchanger.

According to the present air conditioner, the holding plate provided on the wire cover holds the end portion of the pipe cover and fixes the same to the casing main body. This enhances the mechanical strength of the casing main body at and around the pipe draw portion. As a result, it is possible to keep the end portion of the bottom surface side of the casing main body from opening outward.

Next, an embodiment of the subject disclosure will be described with reference to the drawings. However, the technique of the present disclosure is not limited to this.

Figure 2:
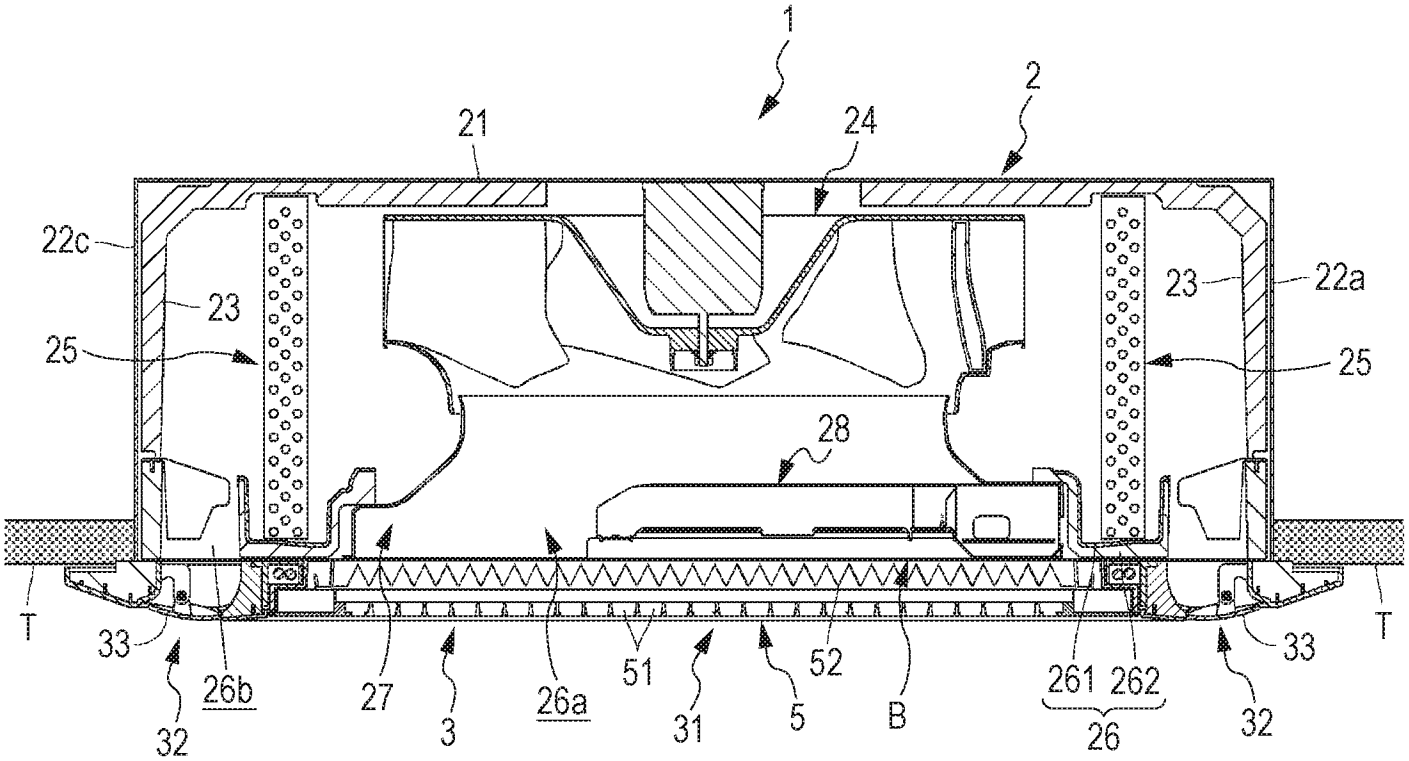
FIG. 2 is a cross-sectional view of main components of the ceiling-embedded air conditioner.

As illustrated in FIGS. 1 and 2, a ceiling-embedded air conditioner 1 includes a cuboidal casing main body 2 and a decorative panel 3. The casing main body 2 is housed in a space formed between a ceiling slab and a ceiling panel T. The decorative panel 3 is mounted on a bottom surface B of the casing main body 2.

Hanging metal brackets 4 are provided at the four corner portions of the casing main body 2. When the hanging metal brackets 4 are locked in hanging bolts, not illustrated, hung from the ceiling, the ceiling-embedded air conditioner 1 is hung from and fixed to the ceiling.

The decorative panel 3 is disposed along a ceiling panel (ceiling surface) T. The decorative panel 3 has an air suction opening 31 opened in a square in the center thereof. Air blowoff openings 32 are disposed at four places to surround the four sides of the air suction opening 31. On the air suction opening 31, a detachable suction grill 5 is provided to cover the air suction opening 31.

The suction grill 5 is a synthetic resin molded article having a square shape. The suction grill 5 covers the air suction opening 31 of the decorative panel 3 and has a plurality of suction holes 51. A dedusting filter 52 is held on the back surface of the suction grill 5. The air blowoff openings 32 are formed in a rectangular shape. The air blowoff openings 32 are provided with rotatable wind direction plates 33. During the stoppage of operation, the air blowoff openings 32 are closed by the wind direction plates 33.

The casing main body 2 is a box-shaped container. The bottom surface B (the bottom surface in FIG. 1) of the casing main body 2 is opened. The casing main body 2 has an octagonal top plate 21 with edges chamfered and four side plates 22*a* to 22*d* extended downward from the sides of the top plate 21. A foamed resin heat insulator 23 is disposed on the inner peripheral surface of the casing main body 2.

The heat insulator 23 is not integrated with the inner surfaces of the side plates 22*a* to 22*d*. Accordingly, the open end side of the casing main body 2 (the end portion 221 (see FIG. 3) of the bottom surface B side) has low mechanical strength. Therefore, the end portion 221 of the bottom surface B side of the casing main body 2 is likely to open outward.

Figure 3:
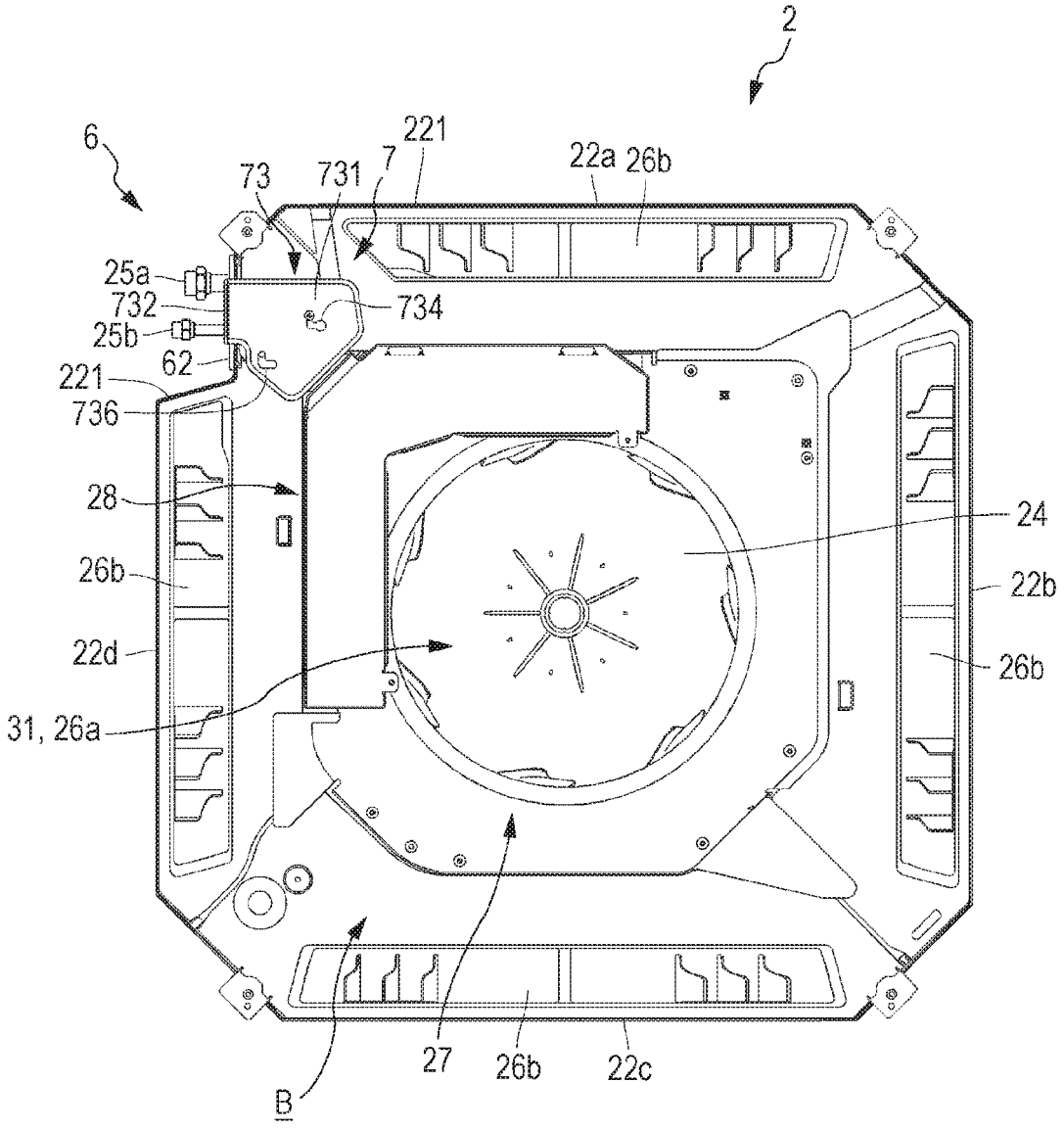
FIG. 3 is a front view of the casing main body without a decorative panel seen from the bottom side.

Referring to FIG. 3, the casing main body 2 is formed such that one of four corner portions (in this example, the corner portion where the side plates 22*a* and 22*d* are butted against each other) is recessed by one step from the outside to the inside. A pipe draw portion 6 is provided at the thus formed concave portion to draw refrigerant pipes 25*a* and 25*b* of a heat exchanger 25 to the outside. That is, the pipe draw portion 6 is formed by cutting out part of the casing main body 2.

As illustrated in FIG. 2, a turbo fan 24 is disposed as an air blower almost in the center of the casing main body 2. The heat exchanger 25 is disposed to surround the outer periphery of the turbo fan 24 on the blowoff side. A drain pan 26 is provided on the lower end side of the heat exchanger 25. The drain pan 26 receives dew condensation water generated by the heat exchanger 25 during cooling operation.

Also referring to FIG. 3, the drain pan 26 has a square shape and is fitted into the casing main body 2 in such a manner as to match the inner peripheral surface of the casing main body 2 on the bottom surface B side across the heat insulator 23. An air suction path 26*a* is provided in the center of the drain pan 26. The air suction path 26*a* communicates with the air suction opening 31 of the decorative panel 3 described later. A bell mouth 27 is provided in the center of the air suction path 26*a*. The bell mouth 27 guides the air sucked through the air suction opening 31 toward the suction side of the turbo fan 24.

The drain pan 26 includes a resin drain sheet 261 receiving dew condensation water and a foamed resin heat insulator 262 integrated with the drain sheet 261. The drain sheet 261 extends partially to the bottom surface B. A screw hole 74 described later is formed in the extending portion.

An electric equipment box 28 is provided on the air suction opening 31 side (front side in FIG. 3) of the bell mouth 27. The electric equipment box 28 is formed in an L shape and extends from the corner portion of the air suction opening 31 adjacent to the pipe draw portion 6 along the side plates 22*a* and 22*d*.

The drain pan 26 has rectangular air blowoff paths 26*b* at four places surrounding the central air suction path 26*a*. The air conditioned through the heat exchanger 25 of the casing main body 2 is passed through the air blowoff paths 26*b* and delivered to the air blowoff openings 32 of the decorative panel 3.

Figure 6:
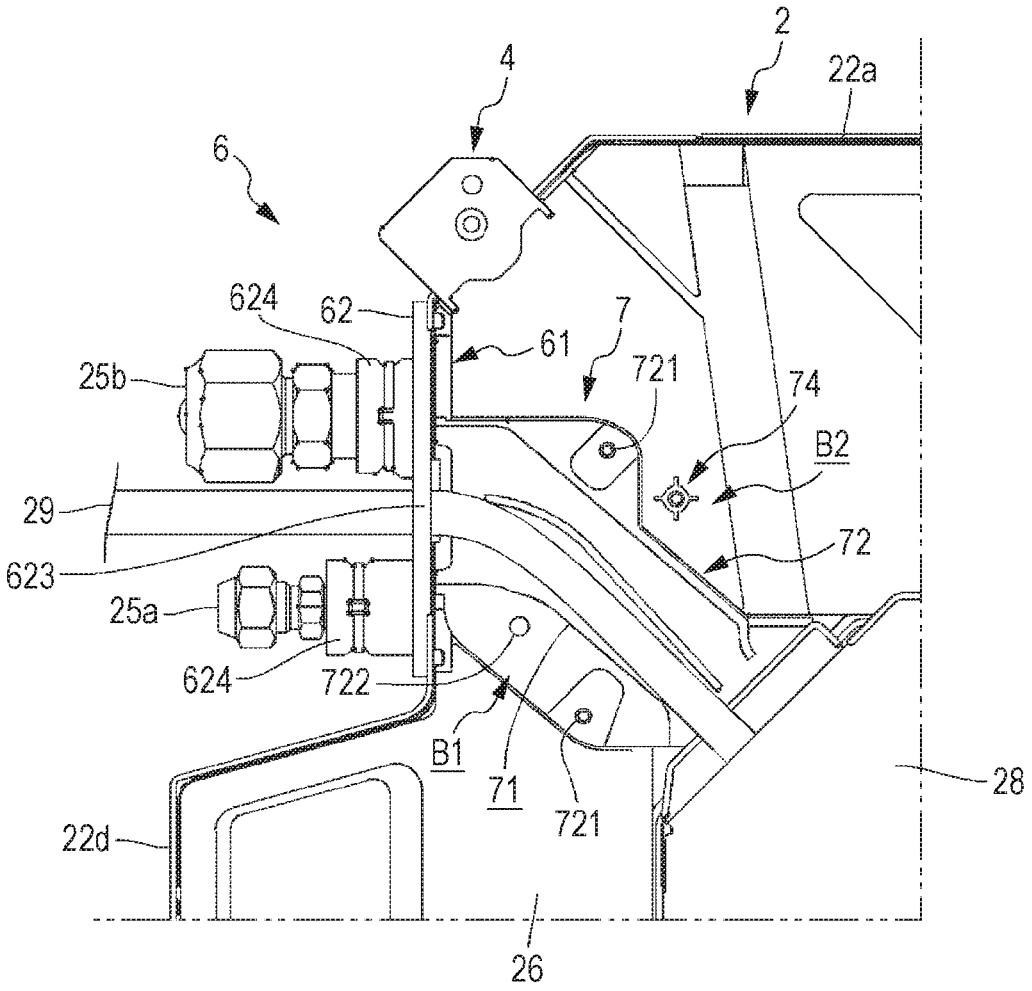
FIG. 6 is a partially enlarged front view of the casing main body without the wire cover.

As illustrated in FIG. 6, a wire guide portion 7 is provided at the corner portion of the drain pan 26 adjacent to the pipe draw portion 6. The wire guide portion 7 guides an electric wire 29 drawn from the electric equipment box 28 to the pipe draw portion 6. The wire guide portion 7 includes a wire guide groove 71 and a wire guide tool 72. The wire guide groove 71 is formed by recessing the bottom surface (front surface in FIG. 6) of the drain pan 26 in a depth direction (depth direction in FIG. 6) such that the wire guide groove 71 penetrates through the drain pan 26 from the inner wall to the outer wall. The wire guide tool 72 is fitted into the wire guide groove 71 in such a manner as to match the inner surface of the wire guide groove 71.

The wire guide tool 72 is made of a resin and formed in a U gutter to match the inner surface of the wire guide groove 71. Screw holes 721 are provided at two places of the lower edge (front surface in FIG. 6) of the wire guide tool 72. The screw holes 721 are used to screw the wire guide tool 72 into the drain sheet 261.

The bottom surface B of the casing main body 2 includes two bottom surfaces B1 and B2 sandwiching the wire guide groove 71 therebetween. An engagement convex portion 722 protrudes from a predetermined position on the one bottom surface B1 (front surface in FIG. 6). The engagement convex portion 722 engages with either one of guide grooves 734 and 736 (in this case, the guide groove 736) of a wire cover 73 described later. In the embodiment, the engagement convex portion 722 is integrated with part of the wire guide tool 72.

The screw hole 74 for a male screw S1 is provided in the other bottom surface B2 (front surface in FIG. 6). The male screw S1 engages with either one of the guide grooves 734 and 736 (in this example, the guide groove 734) of the wire cover. In the embodiment, the screw hole 74 is integrated with the drain sheet 261 wrapping around the bottom surface B side of the drain pan 26. The male screw S1 (screw hole 74) is provided on the casing main body 2 in a predetermined position.

Figure 5:
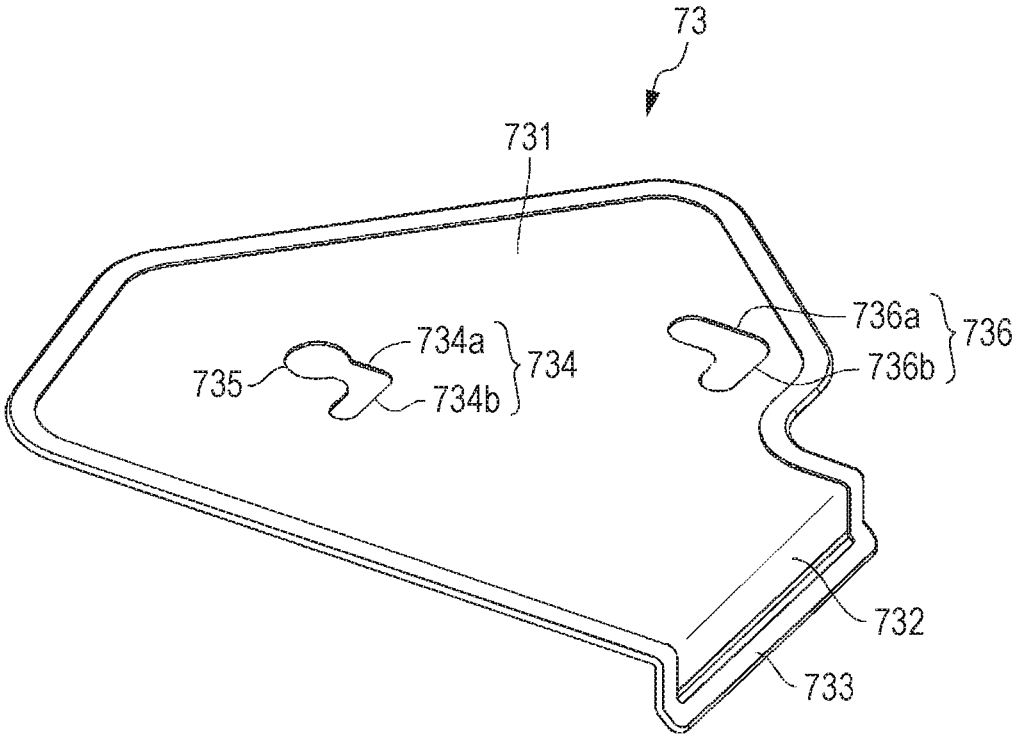
FIG. 5 is a perspective view of a wire cover.

The wire cover 73 is provided on the bottom surface B of the casing main body 2 and cover the wire guide groove 71 for the electric wire 29 formed from the electric equipment box 28 to the pipe draw portion 6. As illustrated in FIG. 5, the wire cover 73 is a metal plate material with an L-shaped cross section and has a cover plate 731 and a hold plate 732. The cover plate 731 is disposed along the bottom surface B of the casing main body 2. The hold plate 732 is folded at a right angle from one end of the cover plate 731 to engage with a pipe cover end portion 623 of a pipe cover 62 described later. The pipe cover end portion 623 of the pipe cover 62 connects to the end portion 221 of the bottom surface B side of the casing main body 2.

The cover plate 731 covers the wire guide groove 71 and is screwed to a predetermined portion of the casing main body 2. The cover plate 731 is sized to cover the wire guide tool 72. The hold plate 732 is formed by folding one end of the cover plate 731 downward almost at a right angle. A tapered portion 733 is provided on the front end side of the hold plate 732. The tapered portion 733 is folded in the direction separating from the cover plate 731.

The cover plate 731 has the guide grooves 734 and 736. To lock the wire cover 73 on the bottom surface B of the casing main body 2, the guide grooves 734 and 736 are used to guide the wire cover 73 to the correct lock position. For the convenience of description, the one guide groove 734 will be referred to as first guide groove 734, and the other guide groove 736 as second guide groove 736.

The first guide groove 734 is formed in an L shape by combining a first guide path 734*a* and a second guide path 734*b*. The first guide path 734*a* extends in a first direction (right-left direction in FIG. 3) orthogonal to one side of the cover plate 731 with the hold plate 732. The second guide path 734*b* extends from one end of the first guide path 734*a* on the hold plate 732 side in a second direction (up-down direction in FIG. 3) orthogonal to the first direction. The front end of the first guide path 734*a* of the first guide groove 734 is perforated with a round hole 735. The round hole 735 is sized to let through the head of the male screw S1 at the time of screwing.

The first guide groove 734 engages with the male screw S1 put into the screw hole 74 described above. Accordingly, the first guide groove 734 is formed in a position corresponding to the screw hole 74.

The second guide groove 736 is formed in an L shape by combining a first guide path 736*a* and a second guide path 736*b*. The first guide path 736*a* extends in the first direction (right-left direction in FIG. 3) orthogonal to the one side of the cover plate 731 with the hold plate 732. The second guide path 736*b* extends from one end of the first guide path 736*a* on the hold plate 732 side in the second direction (up-down direction in FIG. 3) orthogonal to the first direction.

The second guide groove 736 engages with the engagement convex portion 722 described above. Accordingly, the second guide groove 736 is formed in a position corresponding to the engagement convex portion 722. The second guide groove 736 is a groove with a constant width from the start end to the terminal end. The width of the second guide groove 736 matches the outer diameter of the engagement convex portion 722.

Figure 4:
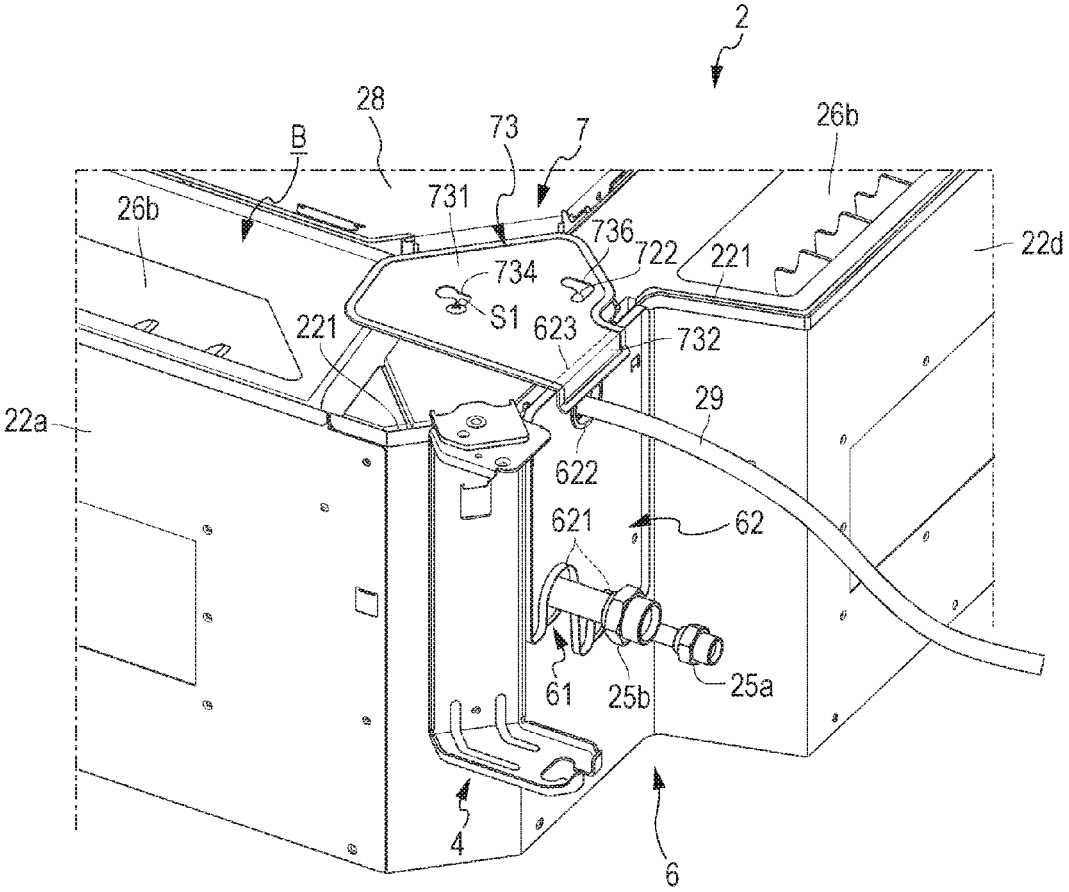
FIG. 4 is an enlarged perspective view of a pipe draw portion of the casing main body.

As illustrated in FIG. 4, the pipe draw portion 6 includes a pipe opening portion 61 and the pipe cover 62. The pipe opening portion 61 is formed by cutting out part of the side plate 22*d* of the casing main body 2 at one corner portion. The pipe cover 62 fixes the outer peripheries of the refrigerant pipes 25*a* and 25*b* in cooperation with the pipe opening portion 61.

In the embodiment, the pipe opening portion 61 is a cutout hole cut out in a U shape from the end portion 221 (upper end in FIG. 4) of the side plate 22*d* on the bottom surface B side to the center in a height direction (up-down direction in FIG. 4). A front end portion of the pipe opening portion 61 (unopened end side) is formed in a semicircle to match the outer peripheral surfaces of the refrigerant pipes 25*a* and 25*b*.

The pipe cover 62 is a metal plate material disposed in parallel to the side surface of the casing main body 2. The pipe cover 62 is configured to cover the pipe opening portion 61 by abutting on the side surface of the peripheral edge of the pipe opening portion 61.

The pipe cover 62 has at two places of the front end semicircular cutout portions 621 formed to match the outer peripheral surfaces of the refrigerant pipes 25*a* and 25*b*. The cutout portions 621 are opposed to the front end portion of the pipe opening portion 61 to form draw holes for fixing the outer peripheral surfaces of the refrigerant pipes 25*a* and 25*b*. That is, the pipe cover 62 fixes the peripheries of the refrigerant pipes 25*a* and 25*b*. Heat insulators 624 with cushioning properties illustrated in FIG. 6 are wound around the outer peripheries of the refrigerant pipes 25*a* and 25*b*. The pipe cover 62 seals the outer peripheral surfaces of the heat insulators 624.

The pipe cover 62 further has a wire draw hole 622 for drawing the electric wire 29 to the outside. The wire draw hole 622 is a through-hole opened toward the wire guide portion 7. The lower end of the pipe cover 62 constitutes the pipe cover end portion 623. The pipe cover end portion 623 connects to the end portion 221 of the bottom surface B side of the casing main body 2. In the embodiment, the pipe cover 62 is detachably attached to the side surface of the casing main body 2 in parallel to the side surface of the casing main body 2. There is no particular limitation on a specific method for attaching the pipe cover 62.

The hold plate 732 provided at the front end of the wire cover 73 is engaged with the pipe cover end portion 623 connecting to the end portion 221 of the bottom surface B side of the casing main body 2 to hold the pipe cover 62. In this state, the cover plate 731 is fixed to the casing main body 2. This enhances the casing main body 2 in mechanical strength at and around the pipe draw portion 6. As a result, it is possible to keep the end portion 221 of the bottom surface B side of the casing main body 2 from opening outward.

Figure 7A:
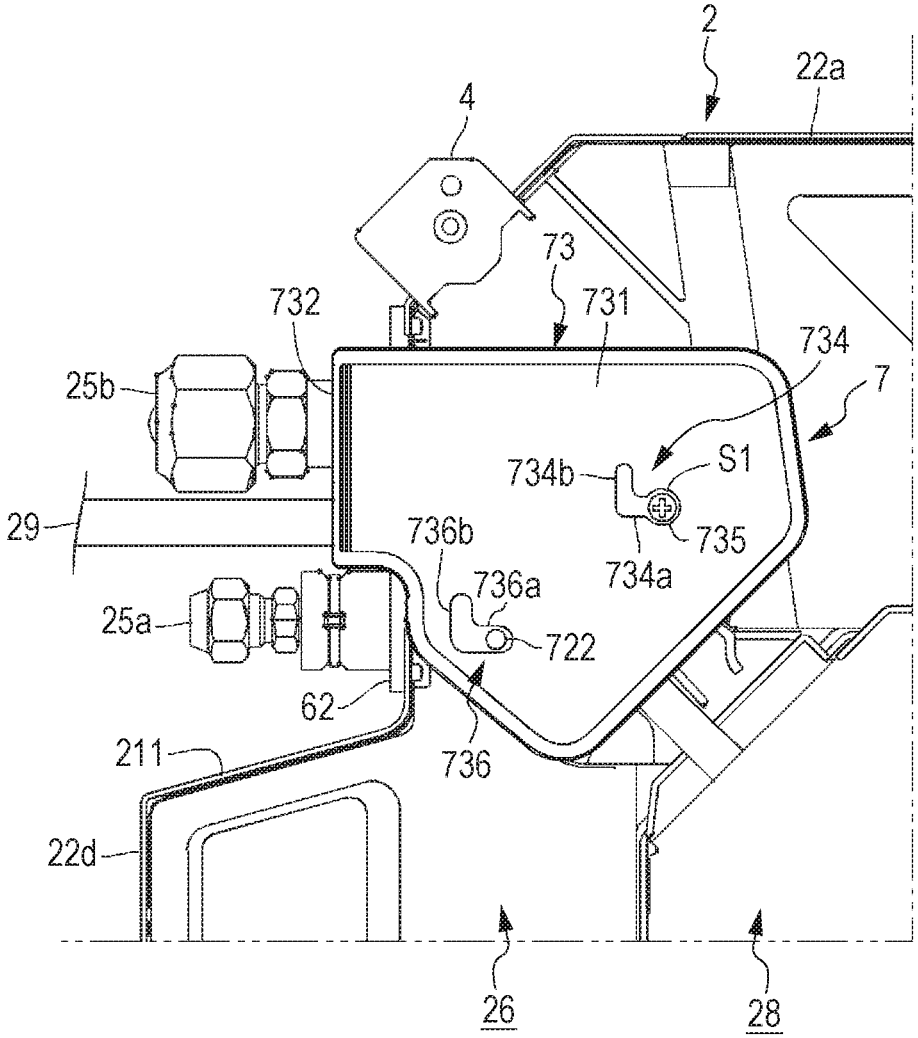
FIGS. 7A to C are partially enlarged front views for describing a procedure for attaching the wire cover.
Figure 8:
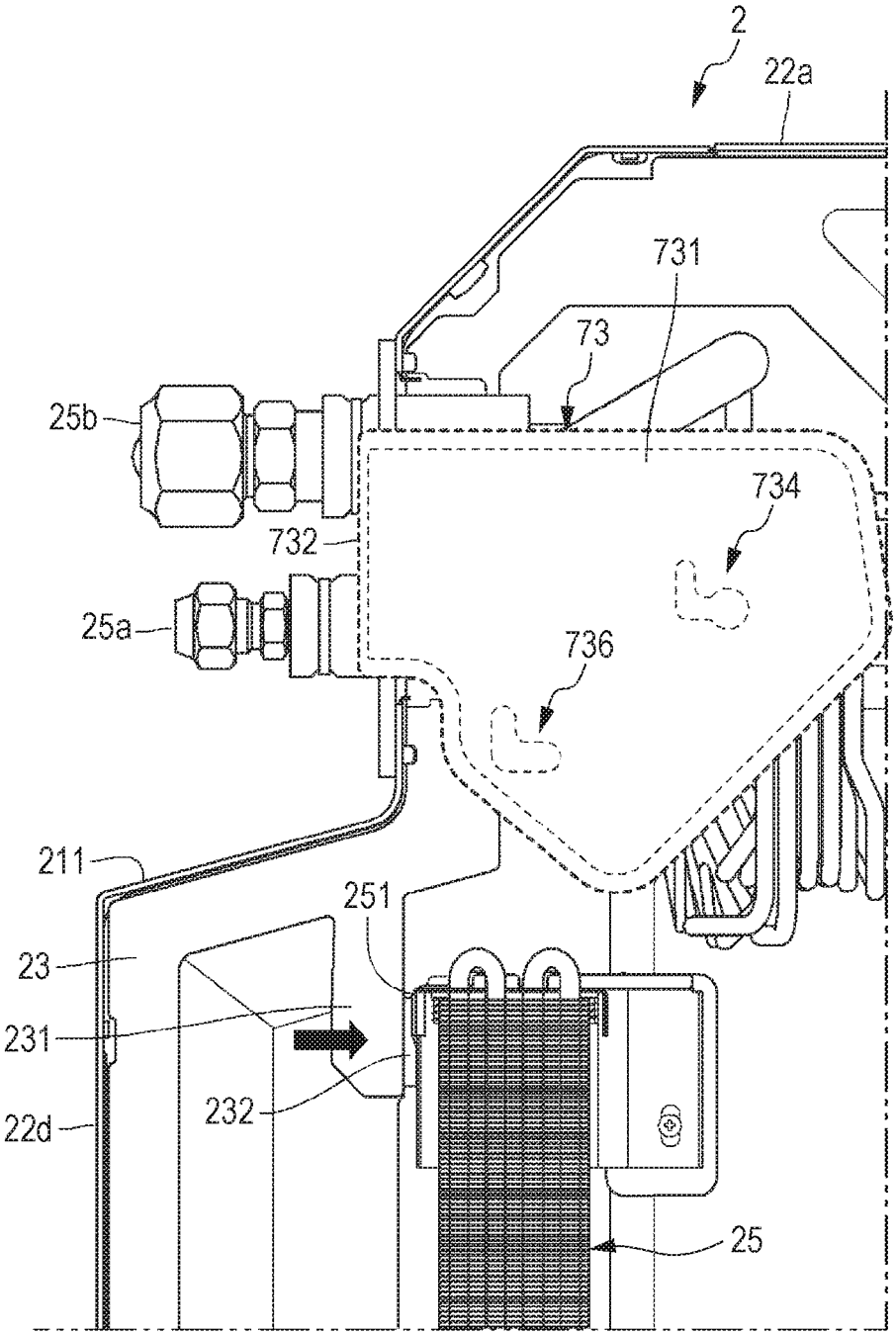
FIG. 8 is a partially enlarged front view for describing the relationship between a seal portion of a heat insulator and a heat exchanger.

FIG. 8 is a diagram in which the drain pan 26, the bell mouth 27, the electric equipment box 28, and the wire guide tool 72 are removed from FIG. 7A. As illustrated in FIG. 8, a seal portion 231 is formed at a predetermined place of the heat insulator 23. The seal portion 231 is in abutment with the side end portion (left end surface in FIG. 8) of the heat exchanger 25. In the embodiment, the heat exchanger 25 has at the side end portion an end plate 251 for fixing the heat exchanger 25 to the casing main body 2. The seal portion 231 is in abutment with the end plate 251.

The seal portion 231 is a convex piece and extends in the direction parallel to the engagement surface between the hold plate 732 of the wire cover 73 and the pipe cover end portion 623. The seal portion 231 is formed from the top surface of the casing main body 2 to the drain pan 26 along the height direction of the heat exchanger 25 (the direction of the plane in FIG. 8).

According to this, when the wire cover 73 is engaged with the pipe cover end portion 623, the seal portion 231 is pressed against the end plate 251 of the heat exchanger 25. Accordingly, it is possible to suppress leakage, from the gap between the seal portion 231 and the end plate 251, of the air having not undergone heat exchange. In the embodiment, a seal member 232 is sandwiched between the seal portion 231 and the end plate 251 to further enhance sealing performance.

Figure 7B:
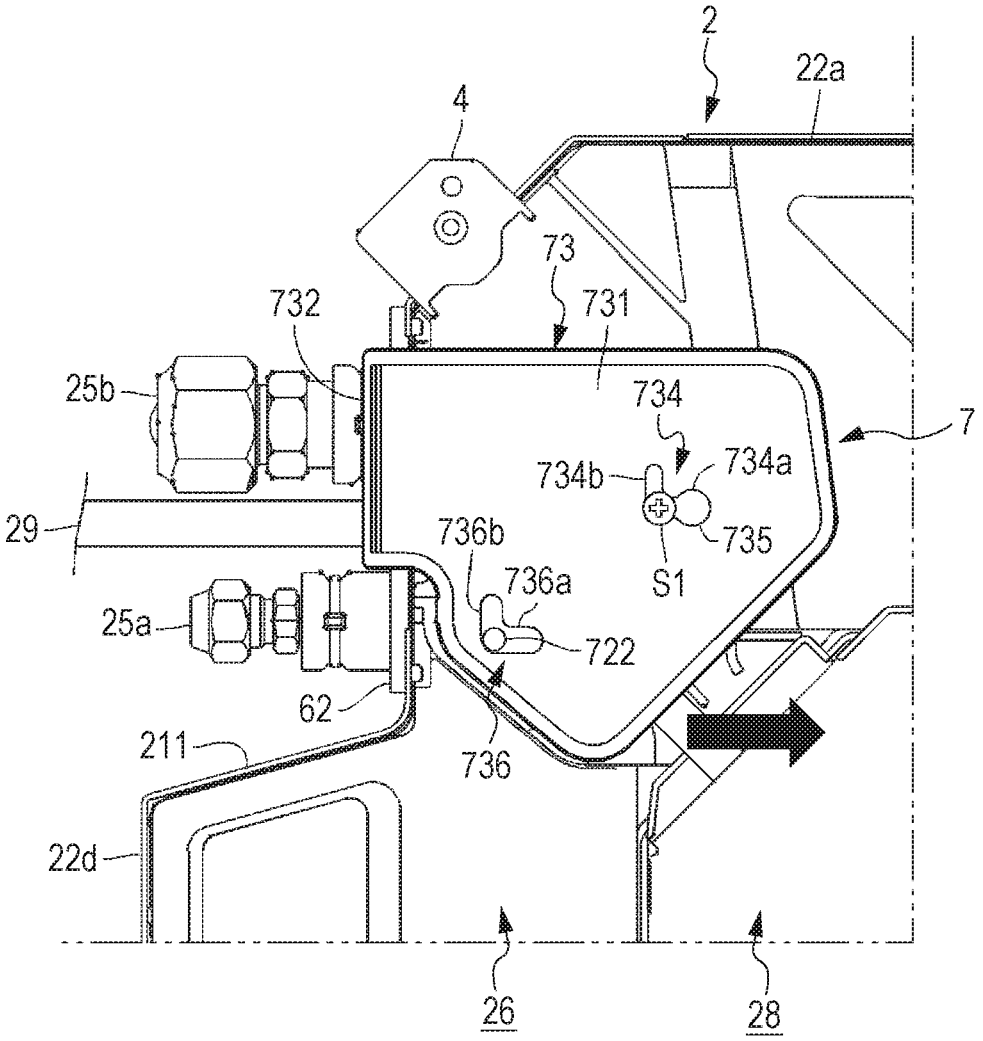
Figure 7C:
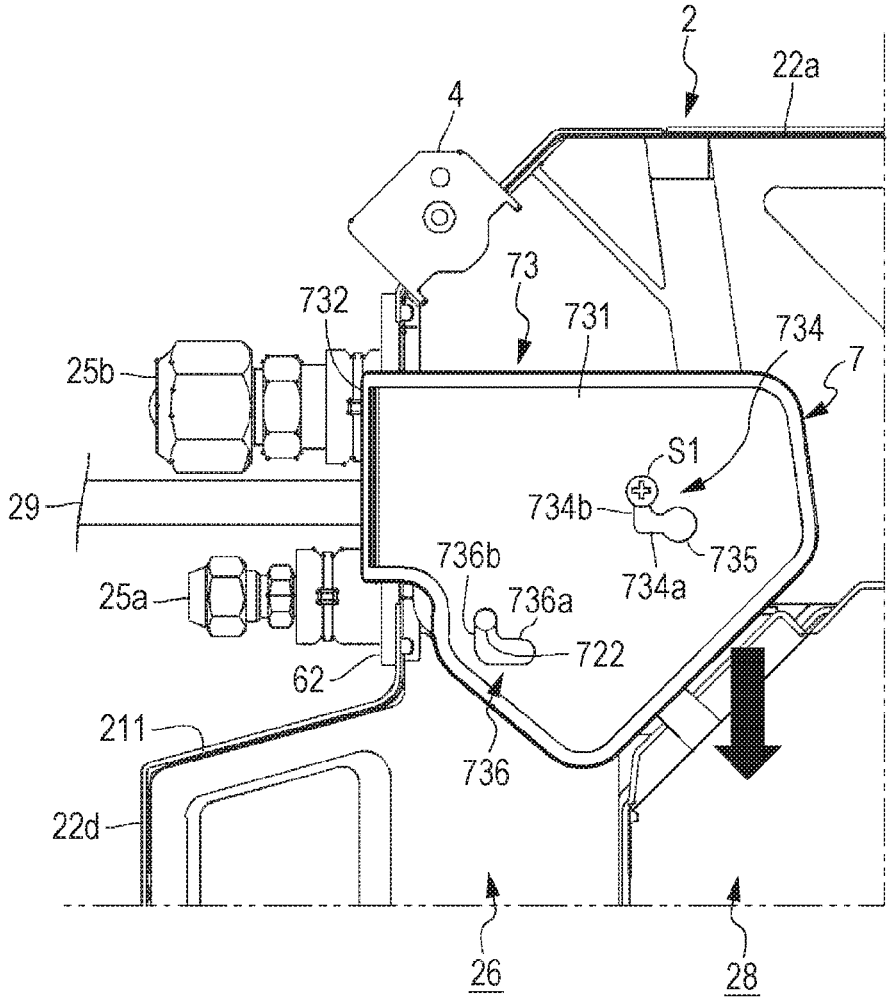

Next, referring to FIGS. 7A to 7C, an example of a procedure for attaching the wire cover 73 will be described. To attach the wire cover 73, first, the male screw S1 is put into the screw hole 74. Then, the head of the male screw S1 is inserted into the round hole 735 of the first guide path 734*a* to engage the first guide groove 734 with the male screw S1.

Next, the engagement convex portion 722 is engaged with the first guide path 736*a* of the second guide groove 736. Then, the male screw S1 is lightly tightened to avoid the engagement convex portion 722 coming off the second guide groove 736 (the state illustrated in FIG. 7A).

Next, the cover plate 731 of the wire cover 73 is slid rightward (in the direction of arrow illustrated in FIG. 7B) along the first guide paths 734*a* and 736*a*. In this manner, the cover plate 731 is moved to the position where the male screw S1 abuts on the terminal end of the first guide path 734*a*. Accordingly, the hold plate 732 elastically abuts on the pipe cover 62 (the state illustrated in FIG. 7B).

Next, the cover plate 731 of the wire cover 73 is slid downward (in the direction of arrow illustrated in FIG. 7C) along the second guide paths 734*b* and 736*b*. In this manner, the cover plate 731 is moved to the position where the male screw S1 abuts on the terminal end of the second guide path 734*b*. At that time, the hold plate 732 is slid downward while elastically pressing the pipe cover 62 (the state illustrated in FIG. 7C).

After that, the male screw S1 is finally tightened. This allows the wire cover 73 to be locked in the wire guide portion 7 of the drain pan 26. In this manner, the male screw S1 supports the movement of the cover plate 731 along the first guide groove 734 and fixes the cover plate 731 to the drain pan 26 in a predetermined position. The engagement convex portion 722 supports the movement of the cover plate 731 along the second guide groove 736.

As described above, according to the embodiment, the hold plate 732 provided at the front end of the wire cover 73 is engaged with the pipe cover end portion 623 connecting to the end portion 221 of the bottom surface B side of the casing main body 2 to hold the pipe cover 62. In this state, the cover plate 731 is fixed to the casing main body 2. This enhances the casing main body 2 in mechanical strength at and around the pipe draw portion 6. As a result, it is possible to keep the end portion 221 of the bottom surface B side of the casing main body 2 from opening outward.

When the wire cover 73 is engaged with the pipe cover end portion 623, the seal portion 231 is pressed against the end plate 251 of the heat exchanger 25. This makes it possible to suppress leakage, from the gap between the seal portion 231 and the end plate 251, of the air having not undergone heat exchange.

The expressions used herein for indicating shapes or states such as "cuboidal," "square," "parallel," "right angle," "orthogonal," and "center" refer to not only strict shapes or states but also approximate shapes or states different from the strict shapes or states without deviating from the actions and effects of the strict shapes or states.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A ceiling-embedded air conditioner comprising:

a ceiling-embedded casing main body that includes a heat exchanger, a turbo fan, and an electric equipment box inside, and has an air blowoff opening and an air suction opening in a bottom surface;

a pipe draw portion that is provided at one corner portion of the casing main body and is formed by cutting out part of the casing main body to draw refrigerant pipes of the heat exchanger together with an electric wire of the electric equipment box;

a pipe cover that is included in the pipe draw portion, fixes peripheries of the refrigerant pipes, and has a draw hole for the electric wire; and a wire cover that is provided on the bottom surface of the casing main body and covers a wire guide groove for the electric wire, the wire guide groove being formed from the electric equipment box to the pipe draw portion;

wherein the wire cover includes a cover plate that covers the wire guide groove, and is screwed to a predetermined place on the casing main body bottom surface; and a bent plate that is folded at a right angle from one end of the cover plate to engage with a pipe cover end portion of the pipe cover on a side of the bottom surface of the casing main body.

2. The ceiling-embedded air conditioner according to claim 1, wherein the cover plate has L-shaped guide grooves at two places, the L-shaped guide grooves have:

first guide paths that extend in a first direction orthogonal to one side of the cover plate, the one side of the cover plate including the bent plate; and second guide paths that extend in a second direction orthogonal to the first direction from ends of the first guide paths, the second guide paths are situated between the ends of the first guide paths and the bent plate on the bent plate side, the casing main body has a male screw and an engagement convex portion in predetermined positions, the male screw is configured to support movement of the cover plate along one of the L-shaped guide grooves and fix the cover plate in a predetermined position, and the engagement convex portion supports movement of the cover plate along another of the L-shaped guide grooves.

3. The ceiling-embedded air conditioner according to claim 1, wherein a foamed resin heat insulator is disposed on an inner peripheral surface of the casing main body, at a predetermined place of the heat insulator, a seal portion in abutment with an end plate of a side end portion of the heat exchanger extends in a direction parallel to an engagement surface between the bent plate and the pipe cover end portion, and when the wire cover engages with the pipe cover end portion, the seal portion is pressed against the end plate of the side end portion of the heat exchanger.

4. The ceiling-embedded air conditioner according to claim 2, wherein a foamed resin heat insulator is disposed on an inner peripheral surface of the casing main body, and at a predetermined place of the heat insulator, a seal portion in abutment with an end plate of a side end portion of the heat exchanger extends in a direction parallel to an engagement surface between the bent plate and the pipe cover end portion, and when the wire cover engages with the pipe cover end portion, the seal portion is pressed against the end plate of the side end portion of the heat exchanger.

* * * * *